US005966820A

United States Patent [19]

Cornacchio et al.

[11] Patent Number: 5,966,820

[45] Date of Patent: Oct. 19, 1999

[54] SHEETROCK PANEL CUTTING DEVICE

[76] Inventors: Michael V. Cornacchio, 2027 Jones Ave., Wantagh, N.Y. 11793; Robert P. Bisey, 2339 Spruce St., Seaford, N.Y. 11783-2924

[21] Appl. No.: 08/686,731

[22] Filed: Jul. 26, 1996

[51] Int. Cl.[6] ..... B26B 29/00

[52] U.S. Cl. ..... 30/286; 30/389; 30/293; 30/294; 7/163; 7/164

[58] Field of Search ..... 30/293, 294, 286, 30/289, 329; 83/13; 7/163, 164, 119; 33/770, 760, 768, 668, 759, 42

[56] References Cited

U.S. PATENT DOCUMENTS

| | | | |
|---|---|---|---|
| 1,029,767 | 6/1912 | Remington | 7/164 X |
| 2,591,333 | 4/1952 | Bellmer | 33/770 |
| 2,818,644 | 1/1958 | Crawford | 30/293 |
| 2,952,025 | 9/1960 | Johnson | 7/163 |
| 3,068,569 | 12/1962 | Campbell, Jr. | 30/294 |
| 4,255,856 | 5/1981 | Mackie | 7/163 X |
| 4,903,409 | 2/1990 | Kaplan et al. | 30/293 |
| 4,949,462 | 8/1990 | Spencer | 30/294 X |
| 4,993,093 | 2/1991 | Goldwitz | 7/163 |
| 5,035,054 | 7/1991 | Ellenberger | 7/163 X |
| 5,048,189 | 9/1991 | Aurness et al. | 30/293 |

*Primary Examiner*—M. Rachuba

[57] ABSTRACT

A sheetrock panel cutting device that is attachable to the end of a conventional metal tape ruler and uses that same tape ruler to not only measure the opening but to also guide the cut of a sheetrock panel while accomplishing both these functions without removing the tape ruler therefrom. A utility knife is inserted into a preformed slot in a base plate which causes the blade of the knife to be aligned juxtaposed to the right angle clip of the tape ruler. The blade protrudes through the base plate and which is directly mounted against the right angle ruler end clip. The device is used to cut a rectangular panel of sheetrock of predetermined size from a full sheet by holding the utility knife, which is positioned in the device, against the sheetrock paper surface with one hand while grasping the metal tape ruler surface, at a previously measured position on the tape, with the other hand against the edge of the sheetrock panel. Once positioned, the workman draws both hands in parallel motion across the surface of the panel, pressing the utility knife into the surface of the sheetrock with one hand and thereby causing the blade of the knife to cut through the sheetrock paper covering, while maintaining contact with the measured position of the ruler against the edge of the sheetrock panel with the remaining hand.

18 Claims, 4 Drawing Sheets

SHEETROCK PANEL CUTTING DEVICE

BACKGROUND OF THE INVENTION

1. Field of the Invention

The present invention relates to a cutting tool. More particularly, the present invention relates to a sheetrock panel cutting tool.

2. Description of the Prior Art

Rectangular panels of sheetrock material are universally used to form walls, ceilings, and other utilitarian and decorative structures and surfaces that are encountered in all phases of the building construction trade.

Typically, sheetrock consists of gypsum material formed into a sheet of standard stock thickness. The gypsum sheet is bonded on both sides with a heavy paper material which greatly enhances the overall strength and integrity of the sheetrock panel and which allows the panel to be cut into smaller panels while still retaining its structural integrity.

Cutting the sheetrock material into custom size panels is typically accomplished by first measuring the space into which the proposed panel will be installed and then transferring these measurements to the sheetrock surface using a pencil and a ruler or other functionally straightedge devices. Finally, a utility knife is used to cut through the paper covering on the previously scribed marking, but only on one side of the panel. After the knife cut is made, the workman positions his hands and forearms on the panel and exerts a bending force on both sides of the panel in proximity to the cut line.

As a result of the brittle nature of the gypsum core material, when sufficient bending force is applied, the gypsum material spontaneously fractures evenly along the entire length of the cut line. Since the fractured section of the sheetrock is still attached to the parent sheet at some arbitrary angle by the paper covering on the opposite side of the sheetrock panel, the workman proceeds to the opposite side and separates the cut panel from the parent sheet by using the same utility knife to cut the paper covering along the creased line caused by the previous act of bending and splitting the panel. Once the paper covering is cut, the desired panel is now free from the parent panel and ready for installation.

Numerous innovations for combination measuring and cutting tools have been provided in the prior art that will be described. Even though these innovations may be suitable for the specific individual purposes to which they address, however, they differ from the present invention.

FOR EXAMPLE, U.S. Pat. No. 4,949,462 to Spencer teaches a drywall cutting device that includes a channel-shaped sleeve for slidably mounted disposition on a stem of a T-square at predetermined selectable positions. A handle operated clamping device is mounted on, and secured with, the channel-shaped sleeve for retaining the sleeve in a predetermined selected fixed position on the stem of the T-square. A handle projects above the sleeve for overlying the T-square. A knife holder is joined with the sleeve, and a knife is adjustable secured with the knife holder at right angles to the channel for cutting a line perpendicular to the stem of the T-square when the clamping device and the T-square are drawn together across a surface to be cut.

ANOTHER EXAMPLE, U.S. Pat. No. 5,295,308 to Stevens el al. teaches a measuring, cutting, and marking tool that incorporates a tape measure that has a case with a holder for a marking or cutting device integrally formed thereon. The tool provides reduced friction for marking and cutting tasks that involves sliding of the tool. Friction reducing elements are provided on the case, e.g. slide pads or rollers. An end clip on the tape has friction reducing means that involve beveled edges, angled wings, or rollers. An intermediary sliding handle between the end of the tape and the case with reduced friction means and a gripping element are provided. A sharpening device for the marking or cutting tool is integrated in the case.

STILL ANOTHER EXAMPLE, U.S. Pat. No. 5,349,760 to DeVito teaches a measuring and cutting tool that includes an extensible tape measure. A mechanism for cutting is on a first end of the extensible tape measure. A structure for guiding is on a second opposite end of the extensible tape measure.

YET ANOTHER EXAMPLE, U.S. Pat. No. 5,379,524 to Dawson teaches a versatile tape measure tool that includes an elongated strip of tape marked off in a linear scale for taking measurements. A casing stores the tape therein in a coiled spring biased condition with the tape being extendable through a first end wall of the casing for measuring. A plurality of components are built into the casing to help in the measuring and cutting to size of plasterboard.

FINALLY, STILL YET ANOTHER EXAMPLE, U.S. Pat. No. 5,430,952 to Betts teaches a tape measure and accessory combination that includes a housing with a retractable tape measure housed therein which can be extended through a slot in the housing, and a blade mounted adjacent the slot so that the blade can use the tape as a straight edge for cutting and scoring. A flashlight bulb is mounted so as to shine along, such as a note surface or pad, a pencil, and an angle finder that incorporates a bubble vile.

It is apparent that numerous innovations for combination measuring and cutting tools have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a sheetrock panel cutting device that avoids the disadvantages of the prior art.

ANOTHER OBJECT of the present invention is to provide a sheetrock panel cutting device that is simple and inexpensive to manufacture.

STILL ANOTHER OBJECT of the present invention is to provide a sheetrock panel cutting device that is simple to use.

When determining the size of a panel required for a given wall or ceiling location, it is necessary to first measure the opening which needs to be filled with the new sheetrock panel. This is facilitated be measuring the opening with a tape measure, then transferring these measurements to the parent sheetrock panel for eventual cutting of the required panel size.

Rather then using a separate tape measure to make and transfer this measurement, applicant has provided a device that is attachable to the end of a conventional metal tape ruler and uses that same tape measure to not only measure the opening but to also guide the cut of the sheetrock while accomplishing both these functions without having to remove the tape measure from the present invention.

The present invention allows the insertion of a conventional utility knife into a preformed slot therein which causes the blade of the knife to be aligned juxtaposed to the right angle clip of the tape ruler. The blade protrudes through a baseplate of the present invention and is directly positioned against the ruler right angle end clip. The device is used to cut a rectangular panel of sheetrock of predetermined size from a full sheet by holding the utility knife, which is replaceably engaged in the present invention, against the sheetrock paper surface with one hand while grasping the metal tape ruler surface, at a previously measured position on the tape, with the other hand against the edge of the sheetrock panel. Once positioned, the workman draws both hands in parallel motion across sheetrock with one hand and thereby causing the blade of the knife to cut through the sheetrock paper covering, while maintaining contact with the measured position of the ruler against the edge of the sheetrock panel with the remaining hand. This action causes a cut line to be formed across the entire width of the sheetrock panel paper surface, which is the first step in the formation of a sheetrock panel of desired size.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
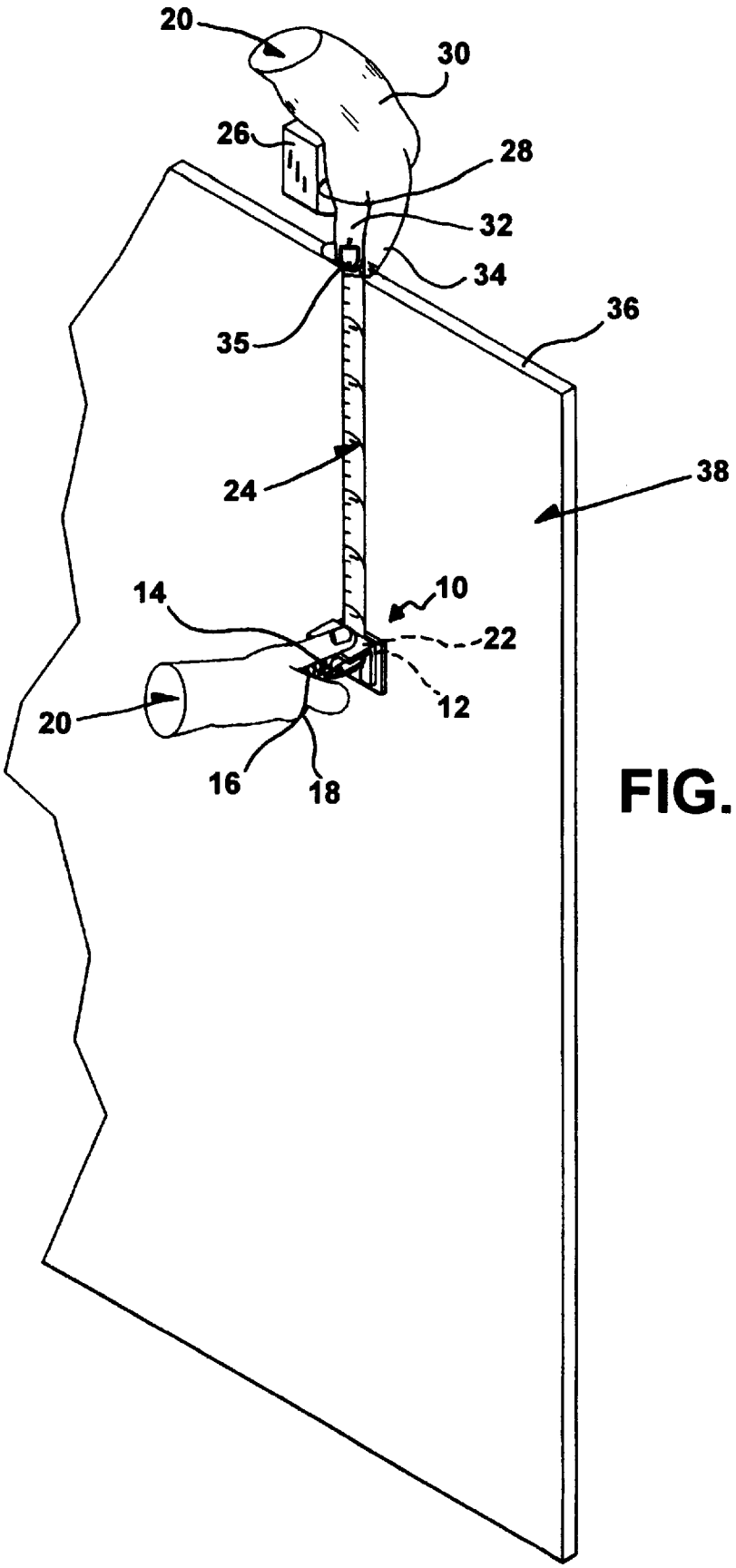
FIG. 1 is a perspective view of the present invention utilizing a conventional tape ruler and a conventional utility knife to cut a sheetrock panel to a desired size.

10 sheetrock panel cutting device of the present invention
12 blade
14 conventional utility knife
16 handle
18 right hand
20 user
22 free end right angle metal end clip
24 conventional metal tape ruler
25 pair of rivets
26 ruler casing
28 palm
30 left hand
32 thumb
34 index finger
35 desired measurement
36 edge
38 conventional sheetrock panel
40 base plate
42 front edge
44 inner edge
46 imaginary longitudinal line
48 imaginary lateral line
50 upper surface
52 rear edge
54 outer edge
56 lower surface
58 throughslot
60 slot
62 pair of throughbores
64 clamping plate
66 gripping portion
68 lower edge
70 portion
72 part
74 upper surface
76 lower surface
78 pair of throughbores
80 part
82 throughslot
84 counter-bore seat
86 pair of retainer sleeves
88 exterior surface
90 interior surface
92 pair of machine screws

DETAILED DESCRIPTION OF THE PREFERRED EMBODIMENT

Referring now to the figures in which like numerals indicate like parts, and particularly to FIG. 1, the sheetrock panel cutting device of the present invention is shown generally at 10 interacting with a blade 12 of a conventional utility knife 14 that is replaceably insertable in the sheetrock panel cutting device 10.

The sheetrock panel cutting device 10 and a handle 16 of the conventional utility knife 14 are gripped by a right hand 18 of a user 20.

Figure 2:
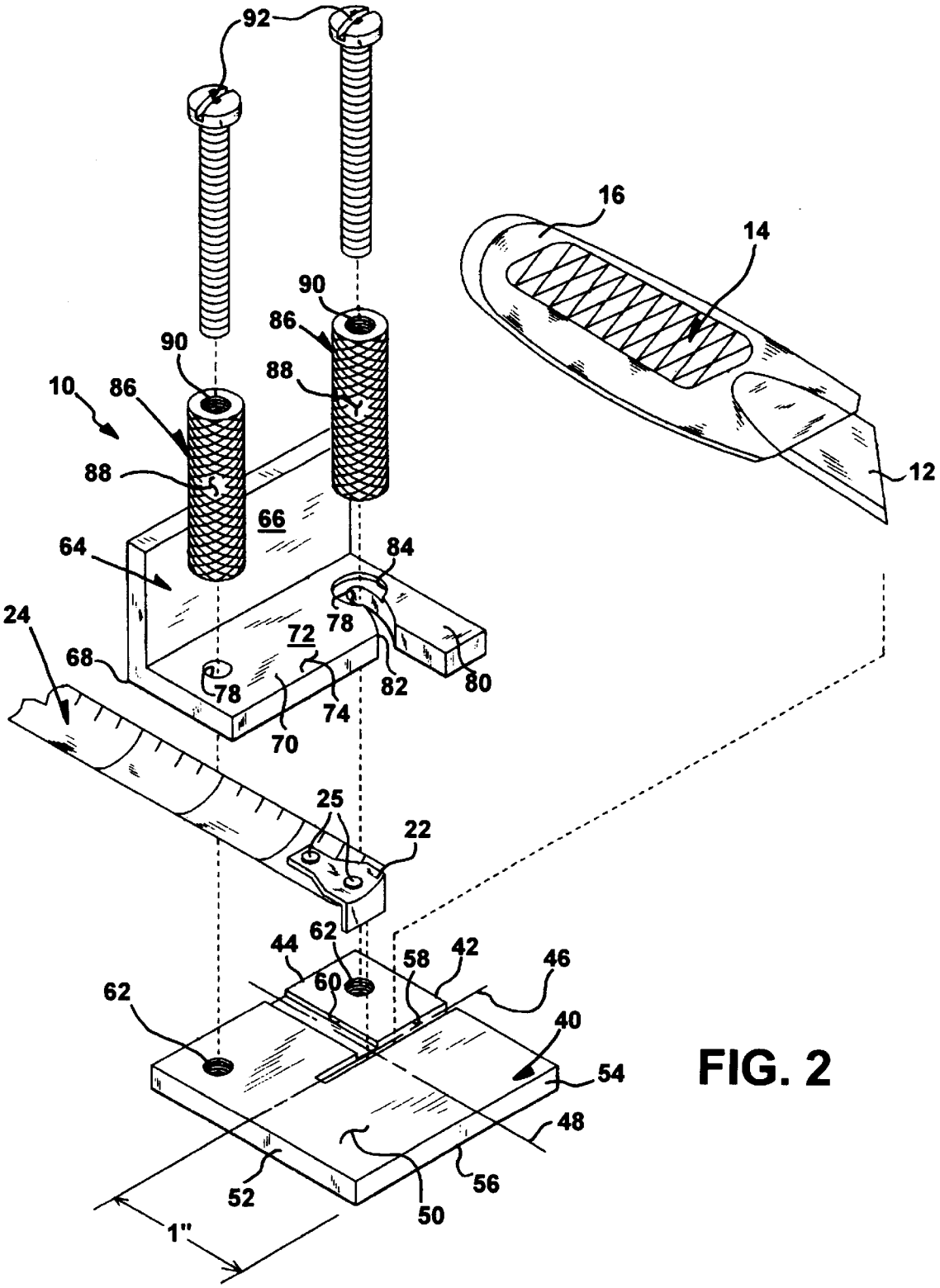
FIG. 2 is an exploded perspective view of the present invention shown in FIG. 1 illustrating the interaction thereof with the conventional tape ruler and the conventional utility knife.

The sheetrock panel cutting device 10 further interacts with a free end right angle metal end clip 22 of a conventional metal tape ruler 24 that is replaceably engagable with the sheetrock panel cutting device 10, and which is fastened to the conventional metal tape ruler 24, by a pair of rivets 25 (see FIG. 2).

A ruler casing 26 of the conventional metal tape ruler 24 is held in a palm 28 of a left hand 30 of the user 20, with a thumb 32 of the left hand 30 and an index finger 34 of the left hand 30 gripping the conventional metal tape ruler 24 at a desired ruler measurement 35 of the conventional metal tape ruler 24, and is maintained thereat by the index finger 34 abutting against an edge 36 of a conventional sheetrock panel 38.

Figure 3:
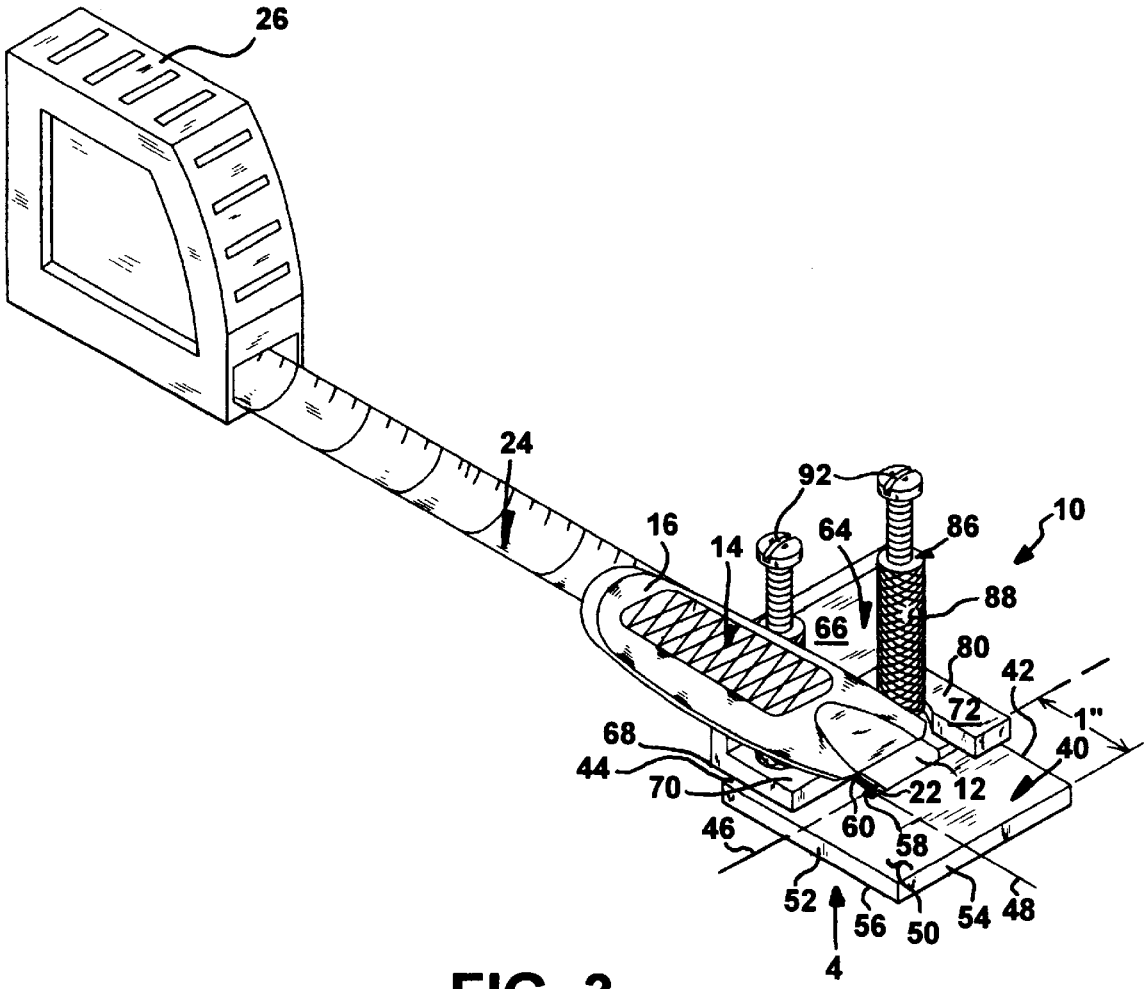
FIG. 3 is an assembled perspective view of the present invention shown in FIG. 1 illustrating the interaction thereof with the conventional tape ruler and the conventional utility knife.
Figure 4:
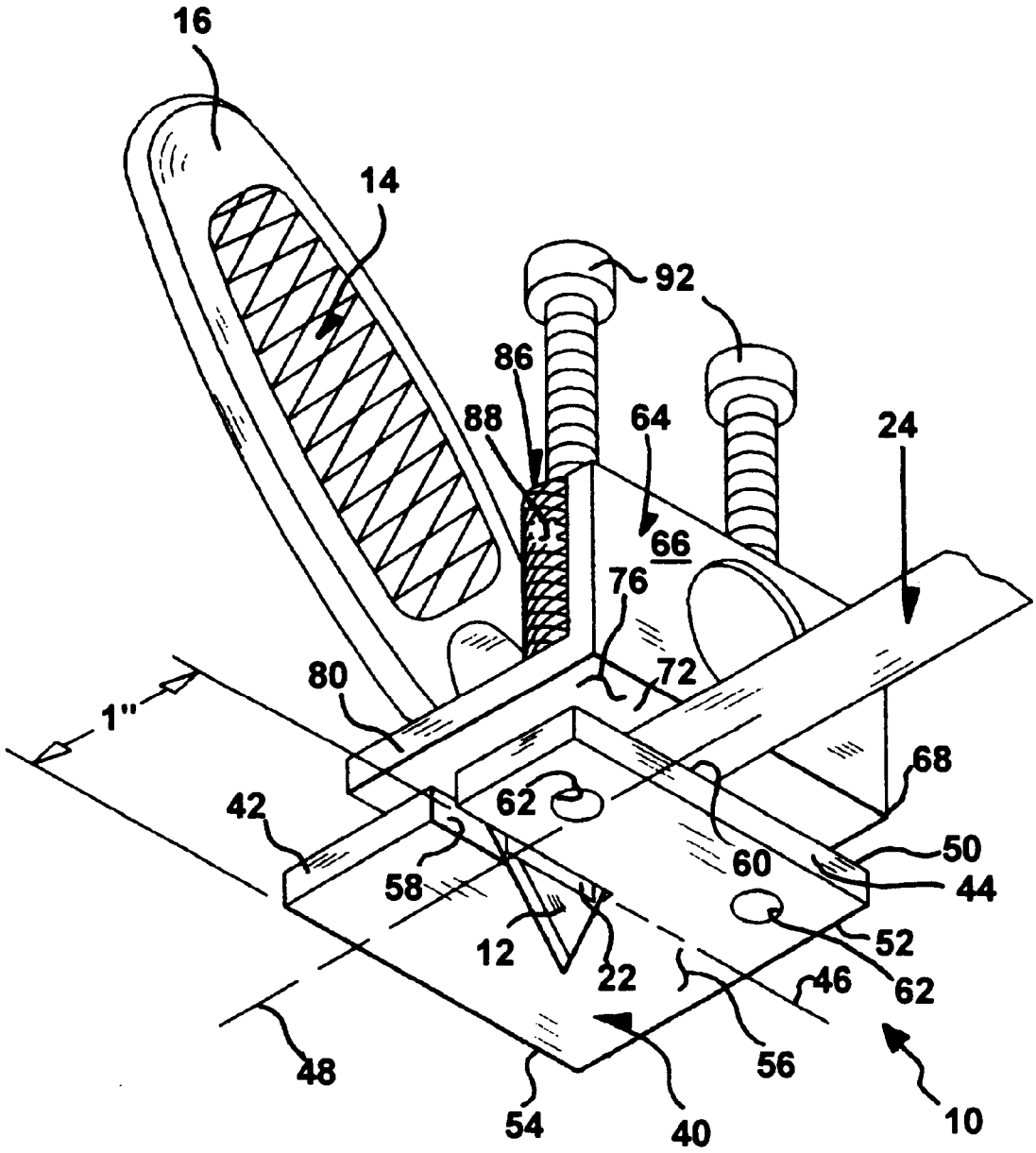
FIG. 4 is a perspective view taken generally in the direction of ARROW 4 in FIG. 3.

The configuration of the sheetrock panel cutting device 10 and its interaction with the conventional utility knife 14 and the conventional metal tape ruler 24 can best be seen in FIGS. 2–4, and as such will be discussed with reference thereto.

The sheetrock panel cutting device 10 includes a base plate 40 that is generally square-shaped and has a front edge 42, an inner edge 44 which is perpendicular to the front edge 42, by virtue of its generally square design, an imaginary longitudinal line 46, an imaginary lateral line 48, an upper surface 50 that is flat, a rear edge 52 that is displaced behind, and parallel to, the front edge 42 and which is perpendicular to the inner edge 44, by virtue of its generally square-shaped design, an outer edge 54 which is displaced from, and parallel to, the inner edge 44, by virtue of its generally square-shaped design, and a lower surface 56 which is flat and displaced below, and parallel to, the upper surface 50.

The imaginary longitudinal line 46 is positioned parallel to, and 1" from, the outer edge 54, while the imaginary lateral line 48 is positioned parallel to, and between, the front edge 42 and the rear edge 52 and perpendicular to the imaginary longitudinal line 46.

The base plate 40 further has a throughslot 58 that is generally rectangular-shaped and continuous and extends therethrough from the upper surface 50 to the lower surface 56.

The throughslot 58 opens into the front edge 42 and extends continuously therefrom, and collinearly along, the imaginary longitudinal line 46, to a point past the imaginary lateral line 48, but prior to the rear edge 52.

The upper surface 50 has a slot 60 that is generally rectangular-shaped, continuous, and shallow and opens into both the inner edge 44 and the throughslot 58, while extending continuously between the inner edge 44 and the throughslot 58, and collinearly along the imaginary lateral line 48.

The shallow slot 60 is preferably machined or cast into the base plate 40.

The base plate 40 further has a pair of throughbores 62 that are partially threaded and spaced-apart and extend therethrough from the upper surface 50 to the lower surface 56.

Each throughbore of the pair of throughbores 62 is disposed between the inner edge 44 and the imaginary longitudinal line 46, and on opposite sides of the imaginary lateral line 48.

The sheetrock panel cutting device 10 further includes a clamping plate 64 that is substantially L-shaped and pivotally mounted to the base plate 40.

The clamping plate 64 has a gripping portion 66 that is flat, vertically-oriented, and generally rectangular-shaped, with a lower edge 68 that is of similar length as, and aligned with, the inner edge 44.

The clamping plate 64 further has a portion 70 that is flat, horizontally-oriented, and substantially L-shaped, with a part 72 that is flat and long and of similar length to, and extends perpendicularly outwardly from, the lower edge 68, to a distance slightly prior to the throughslot 58.

The part 72 has an upper surface 74 that is flat and a lower surface 76 that is flat and positioned below, and parallel to, the upper surface 74. The lower surface 76 is in general abutment with the upper surface 50 of the base plate 40.

The part 72 further has a pair of throughbores 78 that are non-threaded and spaced-apart and extend therethrough form the upper surface 74 to the lower surface 76. The throughbores 78 are vertically aligned with the pair of throughbores 62.

The portion 70 further has a part 80 that is co-planar with, shorter than, and extends perpendicularly outwardly from, the part 72, in proximity to the front edge 42, to a distance past the throughslot 58, but prior to the outer edge 54.

The part 72 further has a throughslot 82 that is arcuate-shaped and continuous and extends therethrough from the upper surface 74 to the lower surface 76.

The throughslot 82 opens into both, and extends continuously between, the innermost point of intersection of the part 72 and the throughbore of the pair of throughbores 78 most closest to the part 80.

The throughslot 82 has a width equal to the diameter of the throughbore of the pair of throughbores 78 to which it opens into and thereby forms a smooth continuous arc with the throughbore of the pair of throughbores 78 to which it opens into.

The throughslot 82 further has a radius of curvature equal to the distance between the pair of throughbores 78, and which originates from the throughbore of the pair of throughbores 78 which it does not open into.

The upper surface 74 has a counter-bore seat 84 that is shallow and concentric with the throughbore of the pair of throughbores 78 into which the throughslot 82 opens.

The sheetrock panel cutting device 10 further includes preventing means which includes a pair of retainer sleeves 86 that are generally cylindrically-shaped, internally-longitudinally-threaded, and externally-knurled.

Each sleeve of the pair of retainer sleeves 86 has an exterior surface 88 that is knurled to facilitate gripping of the pair of retainer sleeves 86, and an interior surface 90 that is longitudinally threaded and vertically aligned with a respective throughbore of the pair of throughbores 78.

The sheetrock panel cutting device 10 further includes pivoting means which includes a pair of machine screws 92 that are conventional threadably engagable and also included in the preventing means.

Each screw of the pair of machine screws 92 threadably engages the interior surface 90 of a respective sleeve of the pair of retainer sleeves 86, passes freely through a respective throughbore of the pair of throughbores 78, and partially threadably engages a respective throughbore of the pair of throughbores 62, so that the free ends of the pair of machine screws 92 internally bind in the base plate 40 and do not protrude from the base plate 40.

Since the throughslot 82 opens into, and is smoothly continuous with, the respective throughbore of the pair of throughbores 78, the respective screw of the pair of machine screws 92 is freely movable in the throughslot 82.

The general steps of utilizing the sheetrock panel cutting device 10 of the present invention are described infra:

STEP 1: Loosen the pair of retainer sleeves 86, by turning the pair of retainer sleeves 86 counterclockwise until the top surfaces of the pair of retainer sleeves 86 are near, or in loose contact with, the heads of the pair of machine screws 92.

STEP 2: Pivot the clamping plate 64 free of the forwardmost screw of the pair of machine screws 92, by rotating the clamping plate 64 counterclockwise about the rearmost screw of the pair of machine screws 92, by virtue of the forwardmost screw of the pair of machine screws 92 moving freely in, and out of, the throughslot 82.

STEP 3: Position the convex side of the conventional metal tape ruler 24 collinearly in the slot 60, with the end lip of the free end right angle metal end clip 22 inserted into the throughslot 58, while the slot 60 forms a refuge for the pair of rivets 25 that may protrude slightly from the convex side of the conventional metal tape ruler 24.

STEP 4: Pivot the clamping plate 64 towards the forwardmost screw of the pair of machine screws 92, by rotating the clamping plate 64 clockwise about the rearmost screw of the pair of machine screws 92, until the forwardmost screw of the pair of machine screws 92 is fully engaged in the throughslot 82.

STEP 5: Exert a slight pulling force on the conventional metal tape ruler 24, in a direction away from the throughslot 58 in the base plate 40, until the inside surface of the end lip of the free end right angle metal end clip 22 contacts the surface of the throughslot 58 nearest the pair of retainer sleeves 86 so as to create a gap between the outside surface of the end lip of the free end right angle metal end clip 22 and the surface of the throughslot 58 furthest from the pair of retainer sleeves 86 sufficient in size to accommodate the subsequent insertion of the blade 12 into the throughslot 58.

STEP 6: Tighten the pair of retainer sleeves 86, by turning the pair of retainer sleeves 86 clockwise, until the bottom surfaces of the pair of retainer sleeves 86 contact the clamping plate 64, with the bottom surface of the forwardmost sleeve of the pair of retainer sleeves 86 fitting into the counter-bore seat 84 so as to lock the clamping plate 64 and thereby cause the clamping plate 64 to come into pressure contact with the conventional metal tape ruler 24, while preventing the clamping plate 64 from loosening and inadvertently rotating during use of the sheetrock panel cutting device 10.

STEP 7: Hold the sheetrock panel cutting device 10 in the right hand 18, with the right hand 18 gripping the gripping portion 66.

STEP 8: Hold the ruler casing 26 in the palm 28.

STEP 9: Position the conventional metal tape ruler 24 over the opening to be covered with the conventional sheetrock panel 38 and hold the outer edge 54 coincident with one edge of the opening or abutment to be covered with the conventional sheetrock panel 38.

STEP 10: Dispense the conventional metal tape ruler 24 from the ruler casing 26 a sufficient amount to reach the opposite parallel edge of the opening or abutment to be covered with the conventional sheetrock panel 38.

STEP 11: Determine the width of the opening or abutment to be covered with the conventional sheetrock panel 38, by visually inspecting the appropriate indica on the conventional metal tape ruler 24. It is to be understood, however, that if a separate ruler independent of that previously maintained in the sheetrock panel cutting device 10 is used to determine the width of the opening or abutment to be covered with the conventional sheetrock panel 38, 1" must be subtracted from the measured opening dimension and then transferred to the conventional metal tape ruler 24 already maintained in the sheetrock panel cutting device 10 before the panel is cut, as a result of the throughslot 58 being 1"from the outer edge 54.

STEP 12: Remove the sheetrock panel cutting device 10 with the conventional metal tape ruler 24 engaged with the sheetrock panel cutting device 10 from the opening or abutment that is to be covered with the conventional sheetrock panel 38 and reposition on the parent piece of conventional sheetrock from which the desired sheetrock panel 38 is to be cut.

STEP 13: Grip the conventional metal tape ruler 24 between the thumb 32 and the index finger 34, at the required width of the conventional sheetrock panel 38 that is used to cover the opening or the abutment.

STEP 14: Abut the index finger 34 against the edge 36 of the parent piece of conventional sheetrock panel so as to form a temporary mechanical stop. It is to be understood, however, that some conventional metal tape rulers 24 are also equipped with a built-in mechanical stop device which, depending upon the effectiveness of the mechanical stop mechanism, can be used to fulfill the identical function described supra of the index finger 34. With the mechanical stop mechanism engaged, the edge of the ruler casing 26 would abut against the panel edge 36 of the parent piece of conventional sheetrock panel.

STEP 15: Extend the sheetrock panel cutting device 10 across the parent piece of conventional sheetrock panel to be cut.

STEP 16: Insert the blade 12 into the throughslot 58 a sufficient amount to cause the blade 12 to protrude through the throughslot 58, and past the lower surface 56. It is to be understood that the closed end of the throughslot 58 stops one edge of the blade 12 from accidentally slipping out, or accidentally moving forwardly or rearwardly in, the throughslot 58, while the part 80 prevents the opposite edge of the blade 12 from accidentally slipping out of, or accidentally moving forwardly or rearwardly in, the throughslot 58 during use of the sheetrock panel cutting tool 10, regardless of which way the blade 12 is inserted into the throughslot 58, since the blade 12 can be inserted either way depending upon cutting requirements. It is to be further understood that the sheetrock panel cutting tool 10 is designed to permit usage with either hand, with the remaining hand being used to hold the tape measure along the top surface of the sheetrock. Thus, a right- or left-handed workman can use the sheetrock panel cutting tool 10 with equal facility and effectiveness. For example, a right-handed workman would hold the conventional utility knife 14 in his right hand and insert the blade 12 into the throughslot 58, with the handle 16 pointing towards the rear edge 52 to produce a cut mark on the sheetrock paper covering, while a left-handed workman would hold the conventional utility knife 14 in his left hand and insert the blade 12 into the throughslot 58, with the handle 16 pointing towards the front edge 42 to produce a cut mark on the sheetrock paper covering.

STEP 17: Hold the sheetrock panel cutting device 10 and the conventional utility knife 14 in the right hand 18, with the right hand 18 gripping both the gripping portion 66 and the handle 16.

STEP 18: Exert a pressure on the conventional utility knife 14 to cause the blade 12 to enter the parent piece of conventional sheetrock panel.

STEP 19: Move simultaneously, in parallel motion, both the right hand 18 and the left hand 30 across the surface of the parent piece of sheetrock panel so as to cause the blade 12 to produce a cut mark parallel to the edge 36 of the parent piece of conventional sheetrock panel on which the index finger 34 abuts against. It is to be understood that in sheetrock work it is not critical that the final cut dimensions must exactly match the dimensions of the opening which is to be covered. Such dimensional discrepancies are easily compensated for through the skilled use of sheetrock tape and joint compound, materials common to the installation of sheetrock material.

It is to be understood that the configurations of the various components of the present invention are not merely a matter of design choice but are significant and of critical importance for, inter alia, the functions that they accomplish as discussed, supra, and any not explicitly expressed but inherent thereto and they therefore must be considered in determining patentability. Support for this assertion can be found in In re Dailey et al., 149 U.S.P.Q. 47 (CCPA 1976), where the Court held that the shape of a device must be considered in determining patentability, if the shape is significant:

> ". . . the configuration of the container is a 'mere matter of choice' not significantly novel . . . , [since] . . . Appellants have provided no argument which convinces us that the particular configuration of their container is significant . . . " [Emphasis added]

It will be understood that each of the elements described above, or two or more together, may also find a useful application in other types of constructions differing from the types described above.

While the invention has been illustrated and described as embodied in a sheetrock panel cutting device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A sheetrock panel cutting device, comprising:

a) a base plate being generally square-shaped and having a throughslot being generally rectangular-shaped and continuous; said throughslot in said base plate receiving a blade of a conventional utility knife and an end lip of a right angled end clip of a conventional tape ruler when said sheetrock panel cutting device is being utilized; said base plate further having an imaginary longitudinal line, an outer edge, an imaginary lateral line, a front edge, a rear edge, a flat upper surface, and a flat lower surface;

b) a clamping plate being substantially L-shaped and pivotally mounted to said base plate, with the conventional tape ruler positioned between said base plate and said clamping plate when said sheetrock panel cutting device is being utilized; said clamping plate providing a gripping surface to assist a user in gripping said sheetrock panel cutting device and a handle of the conventional utility knife;

c) pivoting means for pivotally mounting said clamping plate to said base plate so as to allow said clamping plate to pivot away from said base plate and allow the conventional tape ruler to be positioned on said base plate, with the end lip of the right angled end clip of the conventional tape ruler positioned in said throughslot in said base plate; and d) preventing means for preventing relative pivotal movement between said clamping plate and said base plate, so that when said clamping plate is pivoted onto said base plate, the conventional tape ruler is maintained between said base plate and said clamping plate, with the end lip of the right angled end clip of the conventional tape ruler maintained in said throughslot in said base plate and the blade of the conventional utility knife is prevented from moving forward and backward in said throughslot in said base plate.

2. The device as defined in claim 1, wherein said imaginary longitudinal line of said base plate is positioned parallel to, and 1" from, said outer edge of said base plate, while said imaginary lateral line of said base plate is positioned parallel to, and between, said front edge of said base plate and said rear edge of said base plate and perpendicular to said imaginary longitudinal line of said base plate.

3. The device as defined in claim 1, wherein said throughslot in said base plate extends therethrough from said flat upper surface of said base plate to said flat lower surface of said base plate; said throughslot in said base plate opens into said front edge of said base plate and extends continuously therefrom, and collinearly along, said imaginary longitudinal line of said base plate to a point past said imaginary lateral line of said base plate, and terminates prior to said rear edge of said base plate.

4. The device as defined in claim 1, wherein said flat upper surface of said base plate has a slot that is generally rectangular-shaped, continuous, and shallow and opens into both said inner edge of said base plate and said throughslot in said base plate, while extending continuously between said inner edge of said base plate and said throughslot in said base plate, and collinearly along, said imaginary lateral line of said base plate.

5. The device as defined in claim 4, wherein said slot in said flat upper surface of said base plate is formed in said base plate by a means selected from the group consisting of machined and cast.

6. The device as defined in claim 1, wherein said base plate further has a pair of throughbores that are partially threaded and spaced-apart and extend therethrough from said flat upper surface of said base plate to said flat lower surface of said base plate; each throughbore of said pair of throughbores in said base plate is disposed between said inner edge of said base plate and said imaginary longitudinal line of said base plate and on opposite sides of said imaginary lateral line of said base plate.

7. The device as defined in claim 6, wherein said clamping plate has a vertical gripping portion that is flat, vertically-oriented, and generally rectangular-shaped; said vertical gripping portion of said clamping plate has a lower edge that is of similar length as, and aligned with, said inner edge of said base plate.

8. The device as defined in claim 7, wherein said clamping plate further has a horizontal portion that is flat, horizontally-oriented, and substantially L-shaped; said horizontal portion of said clamping plate has a long part that is flat and of similar length to, and extends perpendicularly outwardly from, said lower edge of said vertical gripping portion of said clamping plate to a distance slightly prior to said throughslot in said base plate.

9. The device as defined in claim 8, wherein said long part of said horizontal portion of said clamping plate has a flat upper surface and a flat lower surface that is positioned below, and parallel to, said flat upper surface of said long part of said horizontal portion of said clamping plate, and which abuts said flat upper surface of said base plate.

10. The device as defined in claim 9, wherein said long part of said horizontal portion of said clamping plate further has a pair of throughbores that are non-threaded and spaced-apart and have diameters, and which extend therethrough from said flat upper surface of said long part of said horizontal portion of said clamping plate to said flat lower surface of said long part of said horizontal portion of said clamping plate, and which are in vertical alignment with said pair of throughbores in said base plate.

11. The device as defined in claim 10, wherein said horizontal portion of said clamping plate further has a short part that is flat, co-planar with, shorter than, and extends perpendicularly outwardly from, said long part of said horizontal portion of said clamping plate, in proximity to said front edge of said base plate, to a distance past said throughslot in said base plate, and short of said outer edge of said base plate.

12. The device as defined in claim 11, wherein said horizontal portion of said clamping plate further has a throughslot that is arcuate-shaped and continuous and extends therethrough from said flat upper surface of said long part of said horizontal portion of said clamping plate to said flat lower surface of said long part of said horizontal portion of said clamping plate.

13. The device as defined in claim 12, wherein said throughslot in said horizontal portion of said clamping plate opens into, and extends continuously between, an innermost point of intersection between said long part of said horizontal portion of said clamping plate and a throughbore of said pair of throughbores in said long part of said horizontal portion of said clamping plate most closest to said short part of said horizontal portion of said clamping plate.

14. The device as defined in claim 13, wherein said throughslot in said horizontal portion of said clamping plate has a width equal to said diameter of said throughbore of said pair of throughbores in said long part of said horizontal portion of said clamping plate to which said throughslot in said horizontal portion of said clamping plate opens into so as to form a smooth continuous arc therewith; said throughslot in said horizontal portion of said clamping plate further has a radius of curvature equal to the distance between said pair of throughbores in said long part of said horizontal portion of said clamping plate which originates from a throughbore in said pair of throughbores in said long part of said horizontal portion of said clamping plate which said throughslot in said horizontal portion of said clamping plate does not open into.

15. The device as defined in claim 14, wherein said flat upper surface of said long part of said horizontal portion of said clamping plate has a shallow counter-bore seat that is concentric with said throughbore of said pair of throughbores in said long part of said horizontal portion of said clamping plate into which said throughslot in said horizontal portion of said clamping plate opens.

16. The device as defined in claim 15, wherein said preventing means includes a pair of retainer sleeves that are generally cylindrically-shaped; each sleeve of said pair of retainer sleeves has a knurled exterior surface to facilitate gripping thereof, and a longitudinally-threaded interior surface that is vertically aligned with a respective throughbore of said pair of throughbores in said long part of said horizontal portion of said clamping plate.

17. The device as defined in claim 16, wherein said pivoting means includes a rearmost one of a pair of machine screws; each screw of said pair of machine screws threadably engages said longitudinally-threaded interior surface of a respective sleeve of said pair of retainer sleeves, and passes freely through a respective throughbore of said pair of throughbores in said long part of said horizontal portion of said clamping plate, and partially threadably engages a respective throughbore of said pair of throughbores in said base plate, so that said pair of machine screws internally bind in said base plate and do not protrude from said base plate.

18. The device as defined in claim 17, wherein said preventing means further includes said pair of machine screws; a forwardmost screw of said pair of machine screws is freely movable in said throughslot in said horizontal portion of said clamping plate, since said throughslot in said horizontal portion of said clamping plate opens into, and is smoothly continuous with, said respective throughbore of said pair of throughbores in said long part of said horizontal portion of said clamping plate, and with a respective sleeve of said pair of retainer sleeves sitting in said shallow counter-bore seat in said flat upper surface of said long part of said horizontal portion of said clamping plate.

* * * * *